US005755522A

United States Patent [19]

Ito

[11] Patent Number: 5,755,522

[45] Date of Patent: May 26, 1998

[54] WINDING MECHANISM FOR RECORDING PAPER

[75] Inventor: Akihiko Ito, Chiba, Japan

[73] Assignee: Seiko Instruments Inc., Japan

[21] Appl. No.: 721,760

[22] Filed: Sep. 30, 1996

[30] Foreign Application Priority Data

Oct. 3, 1995 [JP] Japan ..... 7-256130

[51] Int. Cl.[6] ..... B41J 15/04

[52] U.S. Cl. ..... 400/611; 400/619; 242/538.1

[58] Field of Search ..... 242/412, 413.7, 242/538.1; 400/611, 613, 617, 619

[56] References Cited

U.S. PATENT DOCUMENTS

| | | | |
|---|---|---|---|
| 2,661,910 | 12/1953 | Christoff | 242/545 |
| 4,170,175 | 10/1979 | Conlon, Jr. | 400/619 |
| 5,374,007 | 12/1994 | Murison | 242/538.2 |

FOREIGN PATENT DOCUMENTS

| | | |
|---|---|---|
| 59-230939 | 12/1984 | Japan . |
| 1229672 | 9/1989 | Japan . |
| 380052 | 8/1991 | Japan . |
| 7178991 | 7/1995 | Japan . |
| 496058 | 11/1938 | United Kingdom . |
| 2053863 | 2/1981 | United Kingdom . |

OTHER PUBLICATIONS

IBM Technical Disclosure Bulletin, vol. 19, No. 1, p. 109, Self-Aligning Paper Feed, Bogaczyk et al., Jun. 1976.

*Primary Examiner*—Edgar S. Burr
*Assistant Examiner*—Daniel J. Colilla
*Attorney, Agent, or Firm*—Adams & Wilks

[57] ABSTRACT

A winding mechanism for recording paper is driven by a recording paper feeding motor disposed in a printing mechanism. The winding mechanism comprises a printing mechanism side pulley integrally connected at one end of a platen shaft of the printing mechanism for rotation by the recording paper feeding motor, a winding mechanism side pulley having a winding shaft and disposed in a part of a gear train on the winding mechanism, a belt for connecting the printing mechanism side pulley to the winding mechanism side pulley for transmitting a rotation of the printing mechanism side pulley to the winding mechanism side pulley, and a tension spring for imparting a tension to the belt. A clutch mechanism is disposed in the winding mechanism for maintaining the recording paper at a constant tension. A frame having a winding shaft insertion hole supports the winding shaft for rotation.

7 Claims, 4 Drawing Sheets

WINDING MECHANISM FOR RECORDING PAPER

BACKGROUND OF THE INVENTION

The present invention relates to a winding mechanism for recording paper used in a printer or the like.

In general, in a conventional mechanism of this type, an independent motor specialized for winding the printed recording paper is provided in a recording paper winding section in addition to a motor provided in a printing mechanism of a printer for feeding the recording paper. However, another type system is well known by, for example, Japanese Utility Model Laid-Open No. Hei 3-80052, in which the printed recording paper is wound by utilizing the recording paper feeding motor provided in the printing mechanism of a printer.

The above-described conventional system in which the motor for the recording paper is provided in addition to the recording paper feeding motor within a body of the printer would suffer from a problem that a control circuit for controlling the rotation of the recording paper winding would be necessary in addition to the second motor, which results in increasing costs.

On the other hand, in the system in which the motor provided in the printer body for feeding the recording paper is utilized for taking up the printed paper, there is a problem that it is necessary to effect the adjustment for suitable winding of the printed paper since the recording paper tends to be displaced somewhat right and left when the recording paper is to be taken up. In addition, a rotational torque transmission mechanism from the printer body to the recording paper winding mechanism is not satisfactory. Accordingly, it is difficult to effect suitable adjustment. In fact, it is difficult to take up the recording paper in alignment.

SUMMARY OF THE INVENTION

In order to overcome the above-noted defects inherent in the conventional technology, it is an object of the present invention to provide a recording paper winding device for extremely facilitating a positional adjustment between a printer body and a recording paper winding mechanism and for positively winding recording paper with a simple structure at low cost.

Another object of the present invention is to provide a recording paper winding device in which a belt made of rubber or metal group material is used as a power transmission means between the printer body and the recording paper winding mechanism. For example, the belt comprises a timing belt, a flat belt, a V-belt, a wire belt or the like. A tension of the belt is kept constant during use of using the elastically swinging mechanism, and replacement of the belt is facilitated to improve maintenance characteristics. Even if an abrupt force is applied to the belt from the outside, the outside force is absorbed by the elastically swinging mechanism so that the device including the printer body would not break down.

The structure and novel features of the present invention for the above and other objects will become apparent from the following description and accompanying drawings.

In order to attain this and other objects of the present invention, there is provided a winding mechanism for recording paper, comprising: a printing mechanism side pulley (hereinafter referred to as a drive pulley) fixed at one end of a platen shaft so as to be moved together with the platen shaft; a winding mechanism side pulley (hereinafter referred to as a driven pulley) provided in the recording paper winding mechanism; a belt for coupling the drive pulley and the driven pulley with each other for transmitting a rotation of the drive pulley to the driven pulley; on the winding mechanism side having the above-described driven pulley, a tension spring for always imparting a tension to the belt; a winding shaft disposed somewhat slantingly for winding the printed recording paper discharged from the printer printing mechanism; a clutch mechanism incorporated in the driven pulley for forming a one-way clutch; and a frame having a slot opened at one side and slanted in an opposite direction to a recording paper discharge portion of the printing mechanism for rotatably supporting said winding shaft so as to prevent falling away from the frame, the frame being used as a bearing portion.

According to the structure described above, it is possible to obtain a constant tension, irrespective of the elongation of the belt or the error of the belt, by always imparting the tension to the belt through the tension spring. As a result, it is possible to dispense with the tension spring adjustment.

Also, the recording paper winding shaft provided in the winding mechanism for the recording paper is disposed at a slight angle relative to the platen axial direction of the printing mechanism whereby the recording paper may be wound in alignment around the winding shaft along one edge of the recording paper while the wall of the spool formed at one end of the recording paper winding shaft serves as a guide in contact with the edge of the recording paper.

Furthermore, although the winding diameter of the winding shaft is gradually increased as the recording paper is wound therearound, by the slippage effect of the clutch spring incorporated in the driven pulley, the winding shaft itself may adjust the winding speed of the recording paper in an automatic manner. Accordingly, it is unnecessary to synchronize the rotation of the recording paper winding shaft with the platen shaft by using a control circuit or the like in a winding mechanism which has a specialized winding motor.

DETAILED DESCRIPTION OF THE PREFERRED EMBODIMENTS

The present invention will now be described by way of example with reference to the accompanying drawings.

In the accompanying drawings, the same numeral is used to indicate the same member or component and duplicated explanation therefor will be omitted.

An example in which a timing belt is used as a belt means for connecting a drive pulley and a driven pulley will be explained.

Figure 1:
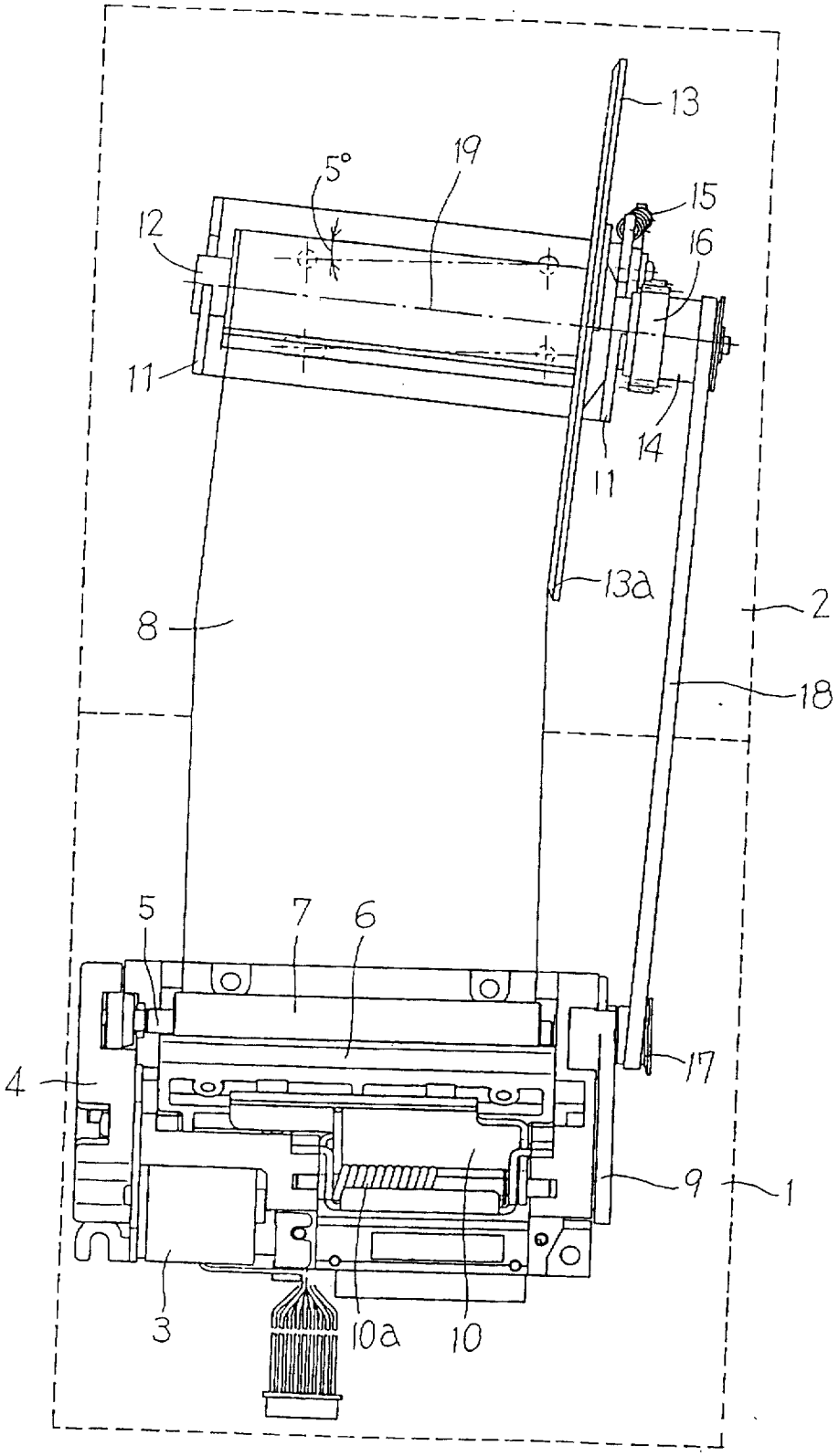
FIG. 1 is a plan view showing an embodiment of the invention.

FIG. 1 is a plan view showing an embodiment of the invention. A printer shown with a winding mechanism is composed of a printing mechanism 1 and a winding mechanism 2.

The printing mechanism 1 will first be explained. A paper feeding motor 3 for suitably feeding recording paper 8 every time printing is ended is adapted to feed the recording paper at a necessary amount by rotating a platen shaft 5 through a gear train 4 provided at a part of the printer mechanism. Also, a drive pulley 17 is provided in a stationary position at one end of the platen shaft 5, so that the rotation of the motor 3 may be transmitted to the outside through the drive pulley 17. A printhead 6 is integrally formed with a heat radiating plate, and is selectively thermally controlled to perform the printing operation on the recording paper 8 while clamping the recording paper 8 with the platen 7. A head-up lever 9 is used to separate the printhead 6 away from the platen 7 when the recording paper is replaced or any paper jam occurs. The head-up lever 9 is axially supported at one end of the platen shaft 5 and the platen shaft 5 is not rotated together with the angular movement of the head-up lever 9 during the head-up operation.

Also, a pressure plate 10 imparts a spring force through a spring or the like to the printhead 6 so that the latter is pressed against the platen 7. As a result, the printhead 6 is elastically pressed against the platen to keep the printable condition for the recording paper 8.

The winding mechanism 2 for the recording paper 8 will now be described.

Figure 5:
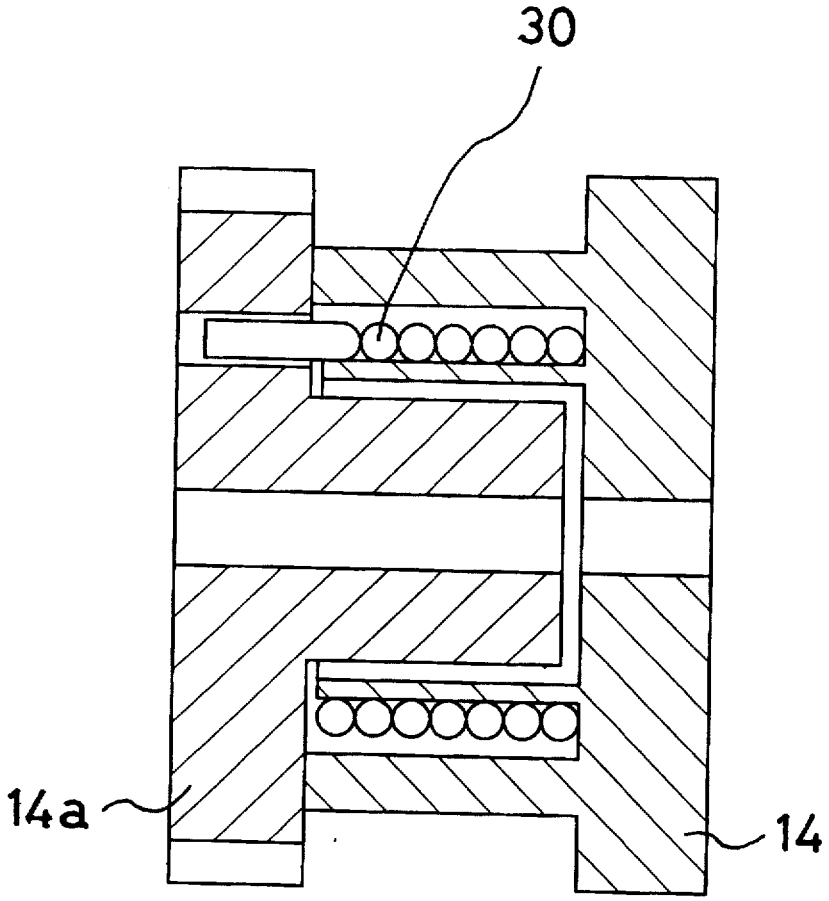
FIG. 5 is a cross-sectional view showing a one-way clutch disposed between the driven pulley and the clutch gear of the embodiment of the invention.

A frame 11 rotatably supports a winding shaft 12 provided in the winding mechanism 2 and detachably holds both ends of the winding shaft 12 to a bearing portion provided in the frame 11. A spool 13 is fixed to one end of the winding shaft 12 to serve as a paper guide when the recording paper 8 is wound. A driven pulley 14 obtains the drive force from the drive pulley 17 to drive the winding shaft 12. A coiled spring 30 is wound around a rotary shaft of the driven pulley 14 to form a one-way clutch (FIG. 5). A gear which engages with an intermediate wheel 16 is formed around the driven pulley 14. The intermediate wheel 16 is rotated in engagement with the winding shaft 12. A gear which engages with the intermediate wheel 16 is formed around the winding shaft 12. Accordingly, in accordance with the rotation of the driven pulley 14, the winding shaft 12 is also rotated through the intermediate wheel 16.

The driven pulley 14 is coupled through the timing belt 18 with the drive pulley 17 fixed to the platen shaft 5 of the printing mechanism 1 and is elastically swingable in engagement with the intermediate wheel 16 about the center of the intermediate wheel 16 by a coiled tension spring 15. As a result, a tension is imparted to the timing belt 18 so that the timing belt 18 cannot be loosened to cause a slippage.

Incidentally, by selecting a material that has essentially no elongation, from the substances set forth in the summary of the invention for the timing belt 18, the obtained belt is durable with a long service life and it is possible to improve the maintenance characteristics. It is understood that a belt other than the timing belt 18, such as for example a flat belt, a V-belt, and a wire belt, is also suitable.

On the other hand, the above-described winding shaft 12 is not parallel with the platen shaft 5 but slanted at about 5° with respect to the parallel condition. Namely, there is no perfect guarantee that the recording paper 8 discharged from the printer mechanism section is always fed to the center of the winding shaft 12. The winding displacement of the recording paper 8 as a result of the phenomenon is prevented.

As shown, the side edge portion of the recording paper 8 is guided in contact with the outer circumferential end 13*a* of the spool 13 by slanting of the winding shaft 12 relative to the platen shaft. Accordingly, the recording paper 8 is shifted on one side of the winding shaft 12 to thereby suppress the generation of the winding displacement. In the embodiment, the slant angle is set at about 5°. However, it is conformed by experiments that the winding displacement may be almost satisfactorily suppressed if the slant angle is in the range of about 3° to 7°.

Figure 2:
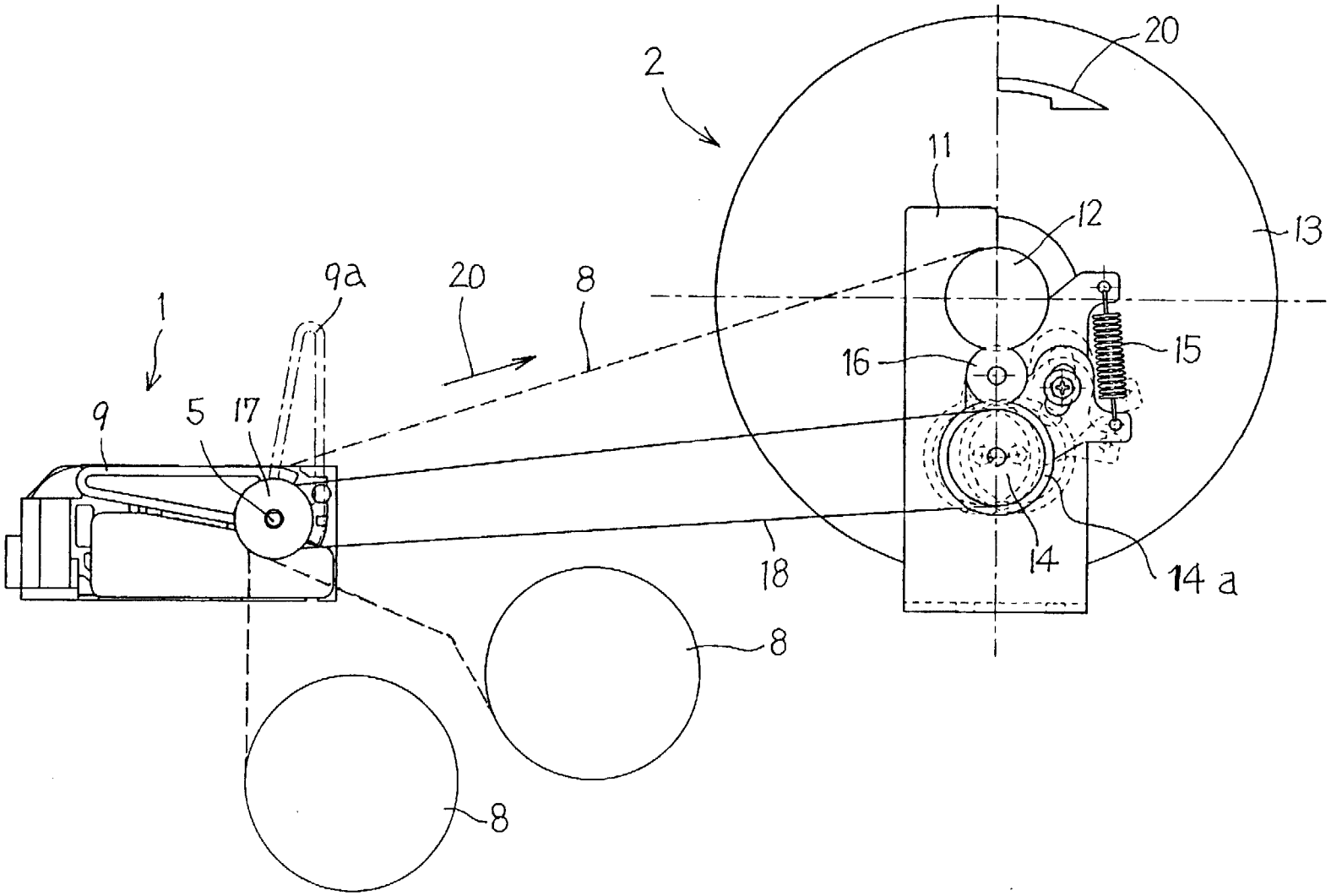
FIG. 2 is a side elevational view schematically showing a right side of FIG. 1.

FIG. 2 is a schematic side view showing a right side of the system. As is apparent from FIG. 2, if the recording paper 8 to be fed to the printing mechanism 1 for printing is disposed in any space below the printing mechanism 1 or a distance between the shafts of the drive pulley 17 on the platen shaft 5 and the driven pulley 14 is changed, the recording paper 8 may be disposed between the printing mechanism 1 and the winding mechanism 2 and it is also possible to feed the recording paper 8 from a part on the platen side. The arrangement position of the recording paper 8 on the feeding side may be freely selected. Accordingly, according to the present invention, there is a large degree of freedom in design, which may contribute to compactness of the printer.

As is apparent from FIG. 2, since the timing belt 18 is always subjected to a constant tension only by the elasticity of the elastic swing mechanism formed on the driven pulley 14, i.e., the tension spring 15, even if the belt would be elongated to some extent, or even if a tolerance is present in the belt dimension allowed by some regulation or, some error is present in the component arrangement during the assembly work, it is unnecessary to effect the belt tension adjustment between the drive pulley 17 and the driven pulley 14.

In the embodiment, the coiled spring is used as the tension spring. However, it is not limited to this type of spring. It is possible to magnetically apply a tension. Also, the belt itself may be formed of rubber. Namely, it is possible to realize the tension applying means by using any type of elastic material if the tension may be applied to the belt.

The one-way clutch composed of the coiled spring 30 incorporated into the driven pulley 14, as shown in FIG. 5, will now be described.

When the recording paper 8 is fed in a direction indicated by an arrow 20, the coiled spring 30 is slipped over a constant torque relative to the clutch gear 14*a* due to the winding direction of the coiled spring. As a result, even if the winding diameter is increased as the recording paper is wound and the difference is generated between the paper feeding speed from the printing mechanism side and the winding speed of the winding shaft, since the driven pulley 14 is formed so as to be integral with the coiled spring 30, the driven pulley 14 is slipped by the action of the clutch mechanism. Thus, the recording paper 8 fed from the printing mechanism is wound at a constant tension.

On the other hand, after the recording paper has been wound at the constant tension, when the winding shaft 12 is stopped by the stop of the paper feed, although some repulsive force is generated opposite the winding direction of the recording paper, the coiled spring 30 is wound in the tightening direction on the shaft of the driven pulley 14. Accordingly, the winding shaft 12 does not slip. In other words, there is no reverse rotation or back rotation. For this reason, there is almost no warpage in the wound recording paper. It is possible to keep the condition that the recording paper is always tensioned between the printing mechanism and the winding mechanism.

Figure 3:
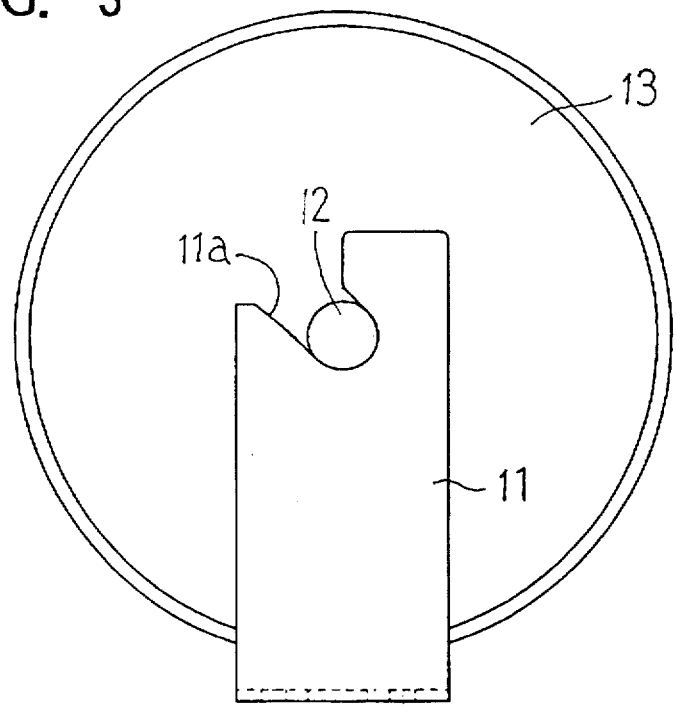
FIG. 3 is a left side elevational view showing a state in which a spool for winding recording paper is mounted on the frame.

FIG. 3 shows a state in which the winding shaft 12 on which the spool 13 for winding the recording paper is mounted is rotatably supported to the frame 11 of the winding mechanism 2.

An upper side of the winding shaft insertion slot 11*a* into which the winding shaft 12 is inserted is opened in the frame 11 so as to be slanted in the opposite direction to the recording paper discharge from the printing mechanism.

In the embodiment, the slant angle of the winding shaft insertion slot 11*a* is at about 45°. This is because, as is apparent from FIG. 2, the direction of the tension force applied to the winding shaft 12 when the recording paper 8 is wound is in the opposite direction to the direction of the winding shaft insertion slot 11*a*, and the slant of the winding shaft insertion slot 11*a* may prevent the winding shaft 12 from falling away from the frame 11 during the winding work. Accordingly, since it is easy to set up the winding shaft 12 simply by falling it into the winding shaft insertion slot 11*a* of the frame 11, it is possible to extremely easily carry out the replacement work for the recording paper.

Figure 4:
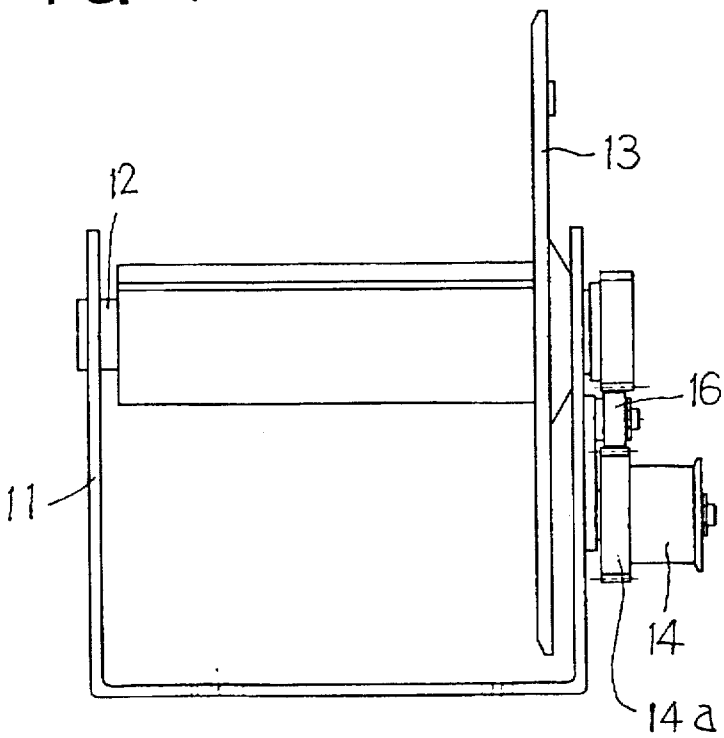
FIG. 4 is a frontal view of FIG. 3.

FIG. 4 is a frontal view of FIG. 3. The winding shaft 12 has different diameters at both ends for providing a kind of fool-proof so as to prevent the opposite insertion of the spool 13 right and left.

Various details of the invention may be changed without departing from its spirit nor its scope. Furthermore, the foregoing description of the embodiment according to the present invention is provided for the purpose of illustration only, and not for the purpose of limiting the invention as defined by the appended claims and their equivalents.

As described above, according to the present invention, there is no motor specialized for winding the recording paper. It is therefore possible to reduce the number of the components for controlling the motor, the gear train or the like. It is possible to provide a system at low cost.

Also, the platen shaft and the winding shaft of the recording paper are coupled with each other through the pulleys and the timing belt. The tension is applied to the timing belt by the tension spring for elastically swinging the driven pulley of the winding mechanism. It is therefore possible to absorb the elongation or contraction of the belt and the dimensional error caused by the manufacture of the belt. As a result, it is unnecessary to effect the adjustment of the belt. Also, there is almost no noise of the belt caused by the power transmission. Also, it is easy to replace belts.

Also, even if any shock is applied to the belt from the outside, the tension spring may absorb the shock. The system does not break down.

Also, even if the recording paper is wound around the winding shaft to increase the winding diameter, the rotation is automatically in synchronism by the slippage effect of the clutch spring provided on the driven pulley. It is unnecessary to provide a mechanism for the synchronism for the difference in winding diameter.

Furthermore, the winding shaft of the recording paper is somewhat displaced to the platen shaft so that the recording paper is guided in contact with the outer peripheral edge of the spool to thereby eliminate the winding displacement or non-uniformity.

Also, the attachment and detachment of the recording paper shaft for replacement of the recording paper may be facilitated by the winding shaft insertion slot formed in the frame.

What is claimed is:

1. A winding mechanism for recording paper, belt-driven by a recording paper feeding motor disposed in a printing mechanism, the winding mechanism comprising:

a printing mechanism side pulley fixed at one end of a platen shaft of the printing mechanism for rotation by the recording paper feeding motor of the printing mechanism;

a winding mechanism side pulley having a winding shaft and provided in a part of a gear train on the winding mechanism;

a belt for coupling the printing mechanism side pulley to the winding mechanism side pulley for transmitting a rotation of the printing mechanism side pulley to the winding mechanism side pulley;

a tension spring for elastically swinging the part of the gear train on the winding mechanism so as to impart a tension to the belt;

a clutch mechanism having a spring and being disposed in the winding mechanism for maintaining the recording paper at a constant tension; and a frame having a winding shaft insertion slot/hole slanted in an opposite direction to a recording paper discharge direction for rotatably supporting the winding shaft.

2. A recording paper winding mechanism according to claim 1; wherein the winding shaft is disposed at a slight angle with respect to the platen shaft.

3. A recording paper winding mechanism according to claim 1; wherein each of the tension spring and the spring of the clutch mechanism comprises a coil spring; and wherein the winding shaft insertion slot comprises a long groove which is opened upwardly relative to the frame at an angle of about 45°, and the winding shaft is disposed at an angle range of about 3° to 7° relative to the platen shaft.

4. A recording paper winding mechanism according to claim 1; wherein the clutch mechanism comprises a one-way clutch.

5. A recording paper winding mechanism according to claim 1; wherein the belt comprises a timing belt.

6. A recording paper winding mechanism according to claim 5; wherein the timing belt is made of metal.

7. A recording paper winding mechanism according to claim 5; wherein the timing belt is made of rubber.

* * * * *